United States Patent [19]

Davis, Jr. et al.

[11] Patent Number: 4,859,173

[45] Date of Patent: Aug. 22, 1989

[54] LOW BTU GAS STAGED AIR BURNER FOR FORCED-DRAFT SERVICE

[75] Inventors: Lester W. Davis, Jr., Randolph; John P. Geosits, Long Valley; Dennis L. Juedes, Randolph; Edward F. Kiczek, Long Valley, all of N.J.

[73] Assignee: Exxon Research and Engineering Company, Florham Park, N.J.

[21] Appl. No.: 101,677

[22] Filed: Sep. 28, 1987

[51] Int. Cl.[4] ..... F23C 5/28

[52] U.S. Cl. ..... 431/175; 431/5; 431/177; 431/9

[58] Field of Search ..... 431/278, 5, 9, 10, 175, 431/176, 177; 110/244, 260

[56] References Cited

U.S. PATENT DOCUMENTS 3,985,494 10/1976 Childree ..... 431/5 X
4,095,929 6/1978 McCartney ..... 431/175 X
4,154,567 5/1979 Dahmen ..... 431/5
4,175,920 11/1979 Guerre et al. ..... 431/175
4,483,832 11/1984 Schirmer ..... 431/5 X

*Primary Examiner*—Larry Jones
*Attorney, Agent, or Firm*—Joseph J. Dvorak

[57] ABSTRACT

In its simplest sense, the burner of the present invention includes a swirl chamber for creating a swirling flow path for primary combustion air. The burner also includes means communicating with the swirl chamber for introducing low heating value gas to the primary combustion air for discharge with the air into a flame zone. Also provided are means adjacent to each other for introducing secondary air and for introducing secondary low heating value gas positioned so that the secondary air and secondary low heating value gas intersect the flame zone, preferably above the region of the recirculating core of the flame and at such a point that the secondary air and low heating value gas have a minimal effect on the swirl aerodynamics of the flame.

8 Claims, 2 Drawing Sheets

LOW BTU GAS STAGED AIR BURNER FOR FORCED-DRAFT SERVICE

BACKGROUND OF THE INVENTION

1. Field of the Invention

The present invention relates to high-intensity staged-air vortex burners. More particularly, the present invention relates to a novel and improved staged-air vortex burner which is suitable for utilizing low heating value fuel under forced-draft service.

2. Description of the Prior Art

In U.S. Pat. No. 3,476,494, there is disclosed a vortex burner which includes a cylindrical combustion chamber and a constant diameter air swirl chamber, the functions of which are to contain and confine the burning process and to achieve a high degree of mixing to ensure completeness of combustion.

In U.S. Pat. No. 3,671,173 there is disclosed an improved high-intensity burner, which eliminates the necessity for a combustion chamber but which nonetheless achieves a high temperature in a relatively small but structurally unconfined volume. The device disclosed in that patent relies upon the principal of vortex air flow to achieve the high temperature in the structurally unconfined volume.

In U.S. Pat. No. 3,746,499, there is disclosed a chamberless vortex burner which employs a swirling auxiliary air flow to achieve a high concentrated degree of fuel-air mixing and high temperature in a relatively small but structurally unconfined volume.

In U.S. Pat. No. 4,175,920, there is disclosed a staged-air vortex chamberless burner which is provided with at least two fuel supply means, making it possible to fire fuel simultaneously at least at two different flow paths.

Each of the foregoing burners, and particularly the last three, have been proven to be entirely satisfactory for their intended purposes. They are not satisfactory, however, for combusting low heating value, i.e., low Btu, gas fuels under forced-draft service.

SUMMARY OF THE INVENTION

Broadly stated, the present invention is predicated on the discovery that a high-intensity, swirl-stabilized vortex burner is capable of operating with low heating value gas under forced-draft service provided that the low heating value gas is injected at intervals in the burner where the effect on swirl aerodynamics is minimized.

In its simplest sense, the burner of the present invention includes a swirl chamber for creating a swirling flow path for primary combustion air. The burner also includes means communicating with the swirl chamber for introducing low heating value gas to the primary combustion air for discharge with the air into a flame zone. Also provided are means adjacent to each other for introducing secondary air and for introducing secondary low heating value gas positioned so that the secondary air and secondary low heating value gas intersect the flame zone, preferably above the region of the recirculating core of the flame and at such a point that the secondary air and low heating value gas have a minimal effect on the swirl aerodynamics of the flame.

In another and preferred embodiment of the present invention, the burner includes means for introducing an additional fuel into the swirl chamber for combustion in the flame zone, thereby permitting operation of the burner with either one or both fuels.

BRIEF DESCRIPTION OF THE DRAWINGS

The underlying principals of the present invention and various embodiments will become apparent from the following description taken in conjunction with the appended drawings, in which.

DETAILED DESCRIPTION OF THE PREFERRED EMBODIMENTS

The embodiment of this invention to be described is designed to combust a low heating value gas, a gas having about 125 Btu/SCF and typically in the range of about 90 Btu/SCF to about 400 Btu/SCF, under forced-draft service. It is to be understood, however, that the invention is not intended to be limited to the embodiments set forth herein for the purpose of that exemplification. It should be readily appreciated that, while the invention will be described in detail with respect to the preferred embodiment, it is understood that many changes may be made in the details of construction and arrangement without departing from the spirit and scope of the disclosure.

Figure 1:
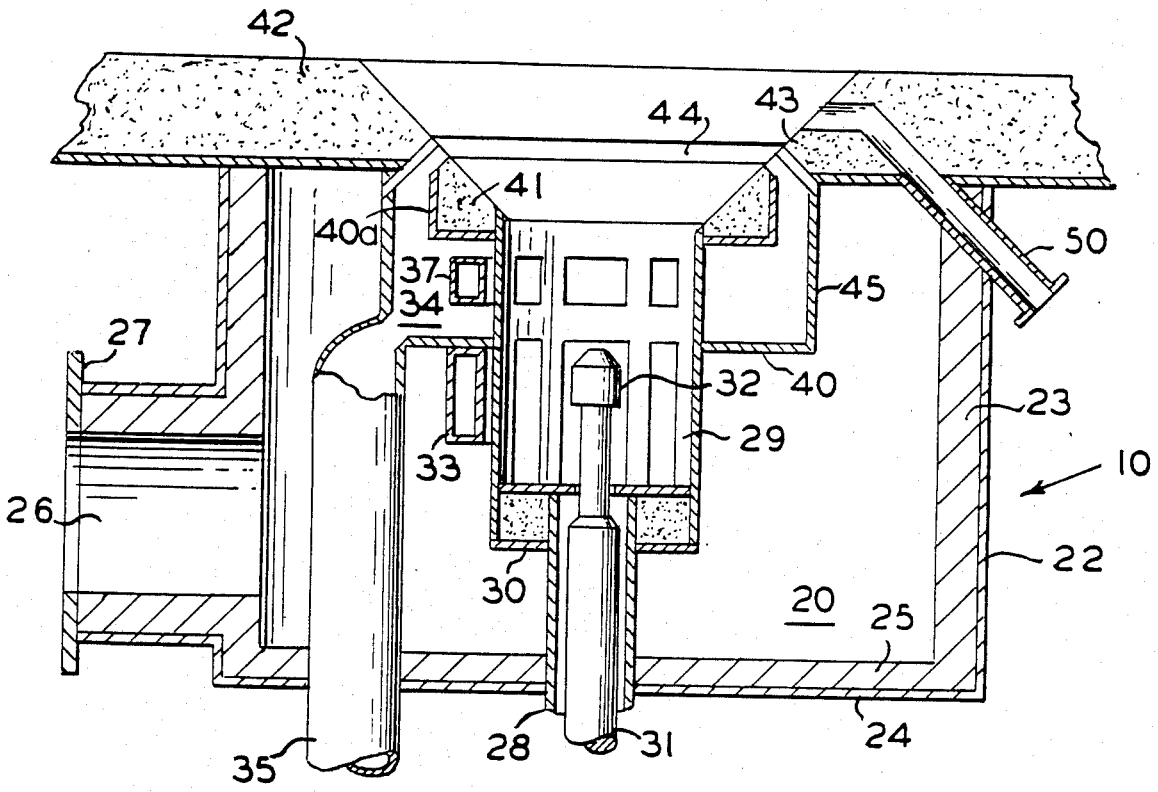
FIG. 1 is a sectional elevation one embodiment of a staged-air burner according to the present invention.

With the foregoing in mind, reference is now made to FIG. 1, in which is shown a chamberless, high intensity vortex burner, generally designated as 10, maintained in a furnace floor or wall 11 by suitable welds or brackets (not shown). The burner 10 has a plenum chamber 20 defined by an outer, substantially cylindrical wall 22 covered on its inner surface with a suitable layer of thermal insulation 23. The plenum chamber 20 also includes an inner end-wall 24 also lined with a suitable thermal insulation 25. The plenum chamber 20 has an inlet conduit 26 through which combustion air, which may be preheated, for example, is forced by means of an external fan (not shown) or the like into the plenum chamber 20. A flange 27 is provided on the inlet conduit 26 of the plenum chamber for connecting the air inlet conduit 26 to an appropriate source of forced air, e.g., an air supply means (not shown).

Figure 2:
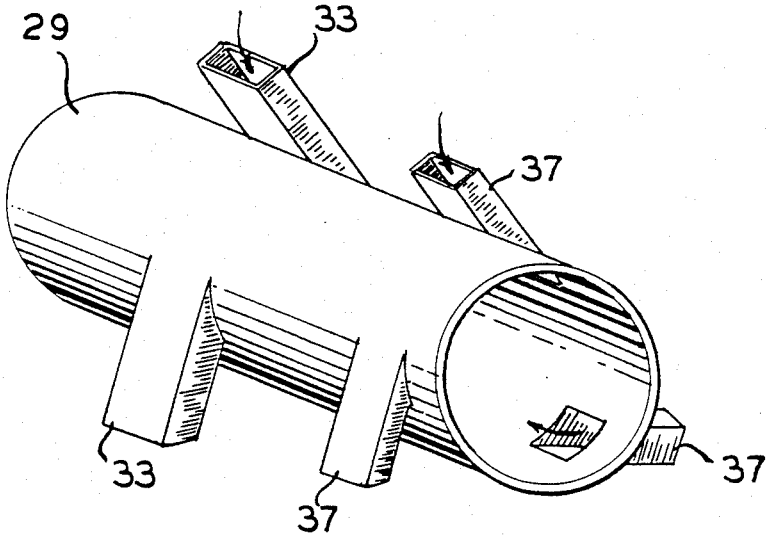
FIG. 2 is a perspective view of swirl chamber 29 of the burner of FIG. 1.

Also, as can be seen from FIGS. 1 and 2, the swirl chamber 29 has a plurality of tangential duct means 33 communicating with the interior of the swirl chamber 29 such that when combustion air is fed under pressure to the plenum chamber 20 it will flow through the duct means 33 along a tangential flow path into the swirl chamber 29, creating a swirling flow of primary combustion air which mixes with the fuel provided to the swirl chamber 29.

As can be seen in FIG. 1, the upper portion of the swirl chamber 29 is surrounded by concentric gas plenum 34. A conduit 35 extends through the floor 24 of the air plenum 20 and through the floor 36 of the gas plenum 34 for providing a low Btu gas from a gas source (not shown) to the plenum 34 for ultimate discharge into the burner for combustion therein. A plurality of tangential ducts 37 are provided which communicate with the gas plenum 34 and the upper section of the swirl chamber 29 for the tangential and swirling introduction of the primary low Btu gas into the swirl chamber. Ducts 37 are oriented in the same direction of air ducts 33 to impart the same tangentially directed swirl to the low Btu gas as is applied to the primary air stream. The relative size of the ducts 33 and 37 is predetermined based on the desired flow of low Btu gas and air into the swirl chamber 29. In general, the relative size is sufficient to provide up to about 20 percent excess air for complete combustion of the fuel.

Figure 3:
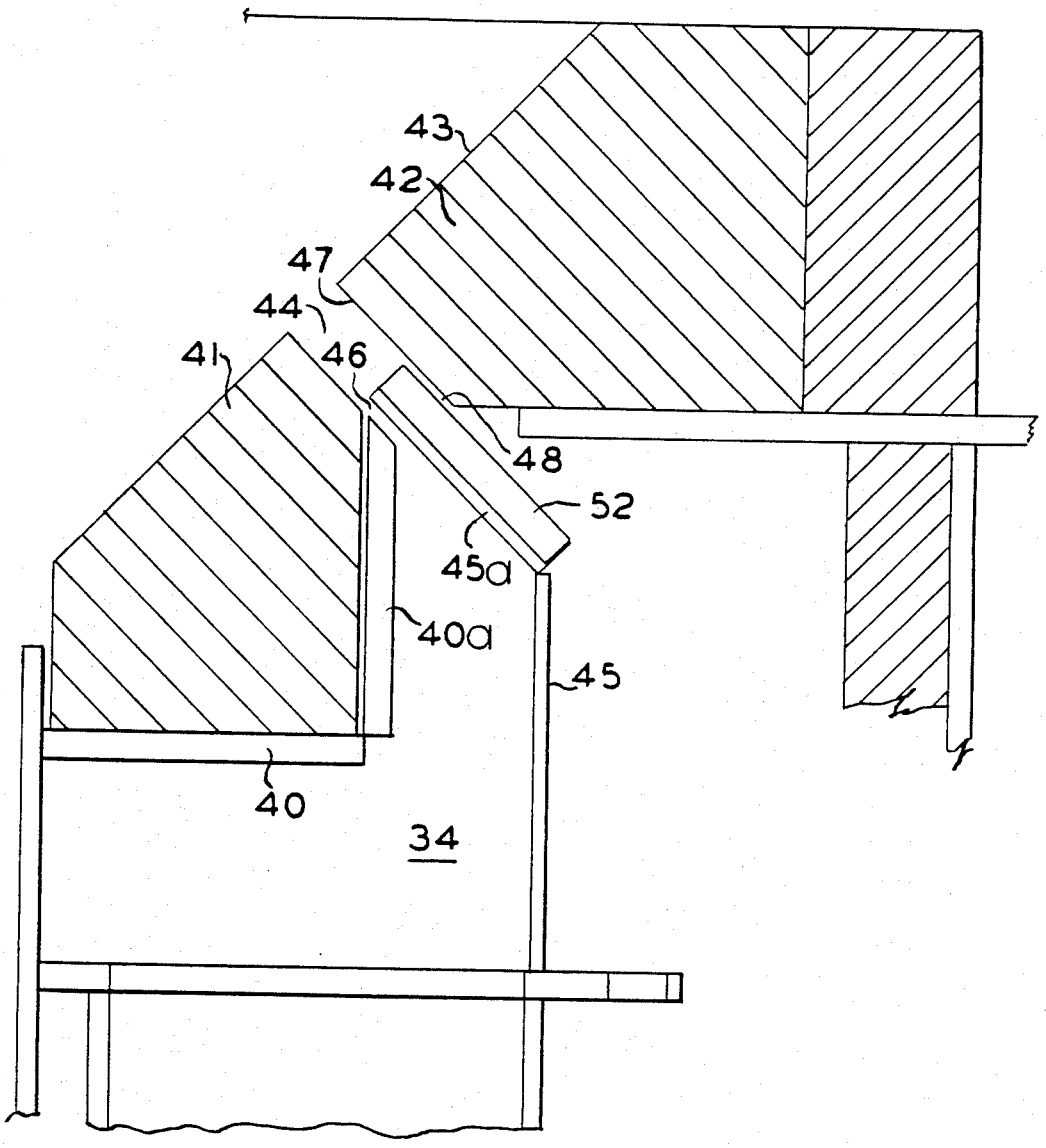
FIG. 3 is a fragmentary sectional elevation of the structure of FIG. 1 showing the secondary air and fuel supply means.

As can be seen from FIGS. 1 and 3, annular primary burner tile 41, made of a suitable high-temperature castable refractory material, meets with the top of the swirl chamber 29. It may be secured thereto by suitable refractory cement and a suitable support plate, such as plate 40. The upper surface of the primary burner tile 41 is outwardly sloping. A second annular burner tile 42 is provided, which has an upper annular surface 43 having a slope substantially similar to and coplanar with the outwardly sloping surface of the primary annular burner tile 41.

As shown in FIGS. 1 and 3, the space 44 between tiles 38 and 42 forms a continuous, uniform annular gap for secondary air and secondary low Btu gas. As can be seen more readily in FIG. 3, the outer wall 45 of the low Btu gas plenum 34 extends upwardly beyond the base of the primary annular ring tile 41 and then extends inwardly toward and terminating just within the entrance to gap 44, thereby defining with vertical wall member 40*a*, annular opening 46 through which low Btu gas enters into gap 44 and thence into the burner. Additionally, the inwardly-directed wall 45*a* of the low Btu gas plenum also serves to define with the sloping bottom surface 47 of the secondary tile 42 a gap 48 through which air flows into gap 44 adjacent to the low Btu gas which enters gap 44 via annular gap 46.

Thus, the burner of the present invention includes substantially a uniform, annular gap extending through the refractory through which secondary low Btu gas and secondary air can be injected adjacent to each other in a convergent direction toward the primary air flow so as to contain the flame envelope and obtain precise flame control and intimate mixing of fuel and air at the approximate point of fuel injection.

It is particularly important in the practice of the present invention that gap 44 is positioned so as to inject the secondary low Btu gas and secondary air into the flame zone at a point of intersection with the flame, preferably above the recirculating core of the main flame. In this way, the secondary gas streams do not penetrate the recirculating core of the flame and have a minimal effect on the aerodynamics of the swirl-stabilized flame.

Figure 4:
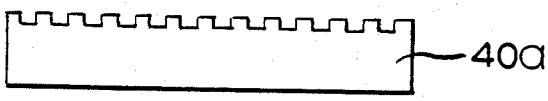
FIG. 4 is a detailed view of a preferred wall member 40*a* of FIG. 3.

It is also particularly preferred in the practice of the present invention that the secondary gap be adjustable. Thus, a number of air gap spacers 52, for example three or more, are provided, the size of which are predetermined based on the desired air flow through gap 48. Indeed, gaps 48 and 46 are sized so as to provide that about 40 to about 50 percent of the low Btu gas and air flows through the primary swirl chamber 29 and the balance flows through the secondary gap 44. This preferably sized ratio will generally require that the width of gap 46, if it is continuous, be relatively small. Therefore, it is particularly preferred to control the flow of low Btu gas into gap 44 by designing gap 46 to consist of a plurality of uniformly distributed slots. Thus, as is shown in FIG. 4, wall member 40*a* is provided with a plurality of slots at the top edge thereof. In this way, 40*a* can be and preferably is extended up to meet with and support 45*a*, with the slots providing proper passage of low Btu gas into gap 44.

It should be noted that the burner is provided with the usual pilot guide tube such as tube 50.

In a particularly preferred embodiment of the present invention, means for combusting an auxiliary or alternate fuel is provided. Thus, as is shown in FIG. 1, extending through the end wall 24 of the plenum chamber 20 in a central aperture is a conduit 28 which extends upwardly and is in operable communication with a centrally- and coaxially-disposed swirl chamber 29. Bushing means, not shown, can be used to assure that conduit 28 maintains a fluid-tight seal around its periphery between the conduit and the base of the plenum chamber 24 and the base 30 of air swirl chamber 29. An oil or high Btu gas fuel supply means 31 having a nozzle 32 is adapted to be placed within conduit 28 with the nozzle extending into the swirl chamber for delivery of fuel therein if so desired. This arrangement, of course, permits simultaneous firing of the burner with the low Btu and auxiliary fuel as well as firing with either fuel.

In operation, air is forced through air duct 26 into plenum 20 through ducts 33 into the swirl chamber 29. The air entering the swirl chamber constitutes the primary air flow. Since it is introduced tangentially into the swirl chamber, a strong vortex flow is established. The remaining portion of the inlet air forced into plenum 20 enters the flame zone through the continuous, annular gap 44. This is the secondary air flow. The low Btu gas enters plenum 34 and through tangential ducts 37 into the air swirl chamber 29 so as to establish a vortex flow and mix with the air and hot gases that are recirculating therein. The portion of the low Btu gas not entering swirl chamber 29 flows through plenum 34 and gap 46 and then through the uniform, annular gap 44 into the burner. Thus, both the secondary air and low Btu gas flow through the gap 44 adjacent to each other into the burner in a direction which shapes the flame inwardly and upwardly to provide a high turbulence zone for mixing the fuel and air to achieve complete combustion.

An auxiliary fuel, oil or gas, optionally is fed into the burner via nozzle 32 of the fuel gun. Indeed, it frequently is preferred to operate the burner by simultaneously supplying both low Btu gas and supplementary fuel.

What is claimed is:

1. A staged-air vortex burner for use in burning low Btu fuel and under forced-draft service comprising a flame zone; a swirl chamber for creating a swirling flow path for primary combustion air and primary low heating value gas; means for discharge into said flame zone; and, means adjacent to each other for introducing secondary air and secondary low heating value gas so as to intersect the flame zone at a point such that the secondary air and secondary low heating value gas have minimal effect on the aerodynamics of the flame.

2. The burner of claim 1 wherein said means adjacent to each other for introducing secondary air and secondary low Btu gas is positioned so that the secondary air and secondary low Btu gas intersect the flame zone above the region of the recirculating core of the flame.

3. The burner of claim 2 wherein said means for introducing secondary low heating gas and secondary air is an annular space surrounding the flame zone.

4. The burner of claim 3 including a common plenum chamber for said primary and said secondary air and a common plenum chamber for said primary and secondary low heating value gas, said air and said low heating value gas plenum chambers having openings communicating with said swirl chamber and said annular gap such that a predetermined ratio of air and low heating value gas is fed into said swirl chamber and into said annular gap in a predetermined ratio.

5. The burner of claim 4 including an auxiliary fuel supply means positioned to discharge auxiliary fuel in said swirl chamber.

6. A staged-air vortex burner for use in burning low Btu fuels under forced-draft service and adapted to be mounted in a furnace having an opening therein comprising, in combination:

a burner casing defining a first plenum chamber;

a conduit opening into said first plenum chamber for forcing air therein;

a swirl chamber having an upper section and a lower section and centrally disposed within said first plenum chamber; a plurality of conduits communicating with said first plenum chamber and said lower section of said swirl chamber whereby air forced into said first plenum chamber enters into said swirl chamber in a swirling flow path;

a second plenum chamber disposed within said first plenum chamber and around the upper end of said swirl chamber;

a conduit for introducing low Btu gas into said second plenum chamber;

a plurality of conduits communicating with the second plenum chamber and said swirl chamber whereby low Btu gas introduced into said second said plenum chamber enters into said swirl chamber in a swirling flow path;

a flame zone;

an outlet at one end of said swirl chamber for discharging said swirling air and said swirling low Btu gas into said flame zone;

an annular refractory tile surrounding said flame zone;

a uniform annular gap in said refractory tile;

means for introducing secondary low Btu gas and secondary air adjacent each other and through said uniform annular gap, said gap being positioned with respect to said outlet of said swirl chamber and said flame zone whereby said secondary air and secondary low Btu gas introduced through said annular gap enters the flame zone above the region of the circulating core of the flame therein.

7. The burner of claim 6 including a conduit for introducing an auxiliary fuel into said swirl chamber.

8. The burner of claim 6 or 7 wherein means for introducing secondary low Btu gas into said annular gap comprises wall member separating said second plenum chamber and said annular gap, said wall member having a plurality of slots along the top edge of said wall through which said low Btu gas passes into said annular gap.

* * * * *